US007422171B2

(12) United States Patent
Huang

(10) Patent No.: US 7,422,171 B2
(45) Date of Patent: Sep. 9, 2008

(54) COMPARTMENT OF SHREDDER FOR RECEIVING PILED-UP SHEETS

(75) Inventor: Simon Huang, SanChung (TW)

(73) Assignee: Michilin Prosperity Co., Ltd., Taipei Hsien (TW)

( * ) Notice: Subject to any disclaimer, the term of this patent is extended or adjusted under 35 U.S.C. 154(b) by 16 days.

(21) Appl. No.: 11/430,121

(22) Filed: May 9, 2006

(65) Prior Publication Data

US 2006/0249609 A1 Nov. 9, 2006

(51) Int. Cl.
*B02C 18/22* (2006.01)

(52) U.S. Cl. ..... 241/225; 241/236

(58) Field of Classification Search ..... 241/222, 241/224, 225, 236, 100; 271/119, 126, 113, 271/3.05, 3.08
See application file for complete search history.

(56) References Cited

U.S. PATENT DOCUMENTS 4,564,146 A * 1/1986 Bleasdale ..... 241/236
4,815,670 A * 3/1989 Iwai ..... 241/34
5,120,043 A * 6/1992 Marzullo ..... 271/117
5,857,671 A * 1/1999 Kato et al. ..... 271/10.11
2005/0274836 A1 * 12/2005 Chang ..... 241/236

* cited by examiner

*Primary Examiner*—Mark Rosenbaum
(74) *Attorney, Agent, or Firm*—Lowe Hauptman Ham & Berner, LLP

(57) ABSTRACT

An improved compartment of shredder for receiving piled-up sheets, including: a pair of longitudinal movable paper press rollers applying pressure to the piled-up sheets continuously; a compartment for receiving piled-up sheets; a pair of rollers capable of feeding paper continuously and paper shredding blades located beneath the paper feed rollers; wherein, the compartment bottom is provide with a narrower platform next to the paper feed rollers, the platform being formed with a paper entry and Y-shaped guide grooves at a center thereof, and the platform being provided at two opposing outer edges with compartment bottom surfaces inclining downwards, the bottom surfaces then extending vertically upwards to form compartment sidewalls, whereby when the piled-up sheets are placed in the compartment, the paper would form opposing upward curvatures along with the inclination of the compartment bottom surfaces in accompaniment with a force applied to the paper at specific locations by the longitudinal movable paper press rollers, thereby facilitating the paper feed rollers in dragging the paper downwardly into the paper shredding blades in a smooth manner.

1 Claim, 2 Drawing Sheets

COMPARTMENT OF SHREDDER FOR RECEIVING PILED-UP SHEETS

CROSS-REFERENCES TO RELATED APPLICATIONS

The Invention claims the priority date of Taiwan Patent Application No. 094207403 filed on 9 May 2005 and having the same title.

STATEMENT REGARDING FEDERALLY SPONSORED RESEARCH OR DEVELOPMENT

Not Applicable

DESCRIPTION

1. Field of Invention

This invention relates to a compartment of shredder for receiving piled-up sheets compartment, particularly to one providing a compartment having a bottom with inclination such that at piled-up sheets are placed in the compartment, the paper would form opposing upward curvatures along with the compartment bottom surfaces thereby facilitating the paper feed rollers in dragging the paper downwardly into the paper shredding blades in a smooth manner.

2. Background

It is widely known that paper shredders for shredding incorporate plural cutting blades and spacers passing through rotary shafts that are driven to rotate towards each other by a motor and gear box so as to shred paper passing through the rotary shafts into strips by shear forces.

The maximum sheet capacity of the conventional paper shredders is dependent on the motor load and the limitations of the cutting blades and rotary shafts. Thus, when a large amount of paper is to be destroyed, the user must continuously feed the paper that is within the maximum sheet capacity of the paper shredded into the paper shredder manually in order to destroy the entire batch of documents.

Paper shredders may provide a peripheral auto-feed that would allow automatic feeding of multiple pieces of paper into paper shredder for shredding, such as that disclosed in TW414725 disclosing a paper feeder capable of automatically feeding documents or piles of paper into a shredder for shredding. The paper includes a pivotal driving roller assembly and a swingable top support. The pivotal driving roller assembly includes a driving roller and a pivotal roller for providing a driving force below a pile of paper, thereby separating a small pile of paper from the entire pile, and advancing the small pile of paper into a paper shredder located at downstream for shredding.

U.S. Pat. No. 5,362,002 discloses a paper shredder with automatic paper feeding device. The feeding device includes a tray which is mounted to the casing adjacent to the shredding roller assembly, a rotary shaft which is mounted rotatably on the tray, a tension spring which is connected to the rotary shaft and the tray, and at least one push rod, each of which having two pivotally connected rod sections. A first one of the rod sections is mounted on the rotary shaft, while a second one of the rod sections is provided with a press piece, which presses against a stack of paper sheets on the tray. The feeding device further includes a pinion which is mounted securely on one end of the rotary shaft, and a wheel which has a sector portion formed with gear teeth and which is driven rotatably by the motor driving unit so as to drive rotatably and intermittently the pinion to rotate correspondingly the rotary shaft against action of the tension spring to cause movement of the press piece and some of the paper sheets toward the shredding roller assembly.

Further, the co-owned U.S. Pat. No. 5,884,855 discloses a paper feed structure for paper shredders having a paper bearing device and paper feed adjustment device. The paper feed structure includes oblique paper bearing plate disposed above wheel cutting blades s of the paper shredder, a paper feed adjustment device, an infrared shielded switch having the function of actuating the paper shredder, a paper feed roller, and slidable plates. Paper need not be fed one by one into the paper shredder manually, and the paper feed amount is adjustable. A pile of paper can be placed on the paper bearing device and the paper is automatically fed into the paper shredder one by one.

The paper feeders and paper shredders described above are in fact independent devices. That is, the paper shredders are peripheral devices that are added to the paper shredders and adopt structure that is similar to the paper feeding tray adopted by the conventional printers. Thus, upon placing a pile of paper in a paper tray, the paper feeder will utilize gear boxes, rods or conveyors to advance the leading surface of the bottommost paper into an inlet of the paper shredder. In other words, such paper feeders require the use of additional motor driving units and driving components and thus involve higher manufacturing cost. In addition, they require space that is beyond that occupied by the paper shredder casing, such that they lack a unified appearance while failing to fulfill their maximum efficacy within minimum space.

WO01/54820A1 entitled "Method for destroying piled-up sheets and device for carrying out said method" discloses a built-in automatic paper-shredding device. With reference to FIG. 1, piled-up sheets 1 are placed over platforms 51, 52 that over a U-shaped compartment bottom in a leveled manner. The platforms 51, 52 are provided at a center thereof with an open channel to serve as a paper entry. A pair of ratchet gears 12 are disposed next to the paper entry. A lift-up presser 20 uses its weight per se to cause the central gears 36 to advance along a longitudinal rack 35 downwards, while link rods 32, 33 continuously apply a force to the piled-up sheets at specific locations. The ratchet gears 12 rotate in opposing directions to half-fold 17 the piled-up sheets sequentially while being dragging downwards into the paper shredding blades 50 for shredding purpose.

Although the automatic paper-feeding device and paper-shredding device are integrated into a built-in type automatic paper-shredding device, the piled-up sheets that are placed over the platforms of the U-shaped compartment bottom in a leveled manner, in order to ensure that the bottom-most paper are smoothly dragged downwards and then half-folded prior to entering the paper shredding blades for shredding purpose, the presser provided above the piled-up sheets needs to continuously apply a downward force. It can be seen that the mechanism of he lift-up presser is relatively complicated in structure, because highly precision components are needed to be assembled in order to ensure consistent and uniform downward application of force towards the piled-up sheets, in order to facilitate the continuous feeding operation of the ratchet gears. However, the overall cost for manufacturing a shredder having such a mechanism is high such that it is less competitive in the commercial market. The design that meets the needs cannot meet the cost-conscious mind of the customers, whereby in the market of shredders where cost and functions are both essential factors, the relatively lower competitiveness prevents commercialization of such design.

As stated above, in order to apply a continuous, steady and uniform downward force towards the piled-up sheets, highly precision components are needed to assemble the lift-up presser. In other words, the lift-up presser takes up a majority of the manufacturing cost. Accordingly, in order to reduce the manufacturing cost of such a built-in automatic paper-shredding device thereby ensuring a competitive product, the only solution is to simplify the structure of the lift-up presser but without affecting the continuous, steady and uniform downward force being applied towards the piled-up sheets. It is thus a subject matter to be developed by this industry to provide an automatic paper-feeding mechanism built-in a shredder body, in order to reduce the space required, while providing a competitive price.

SUMMARY OF INVENTION

It is primary object of this invention to provide an improved compartment of shredder for receiving piled-up sheets, where an inclination provided to the compartment bottom surfaces to facilitate the paper feed rollers in dragging the paper downwardly into the paper shredding blades in a smooth manner.

It is another object of this invention to provide an improved compartment of shredder for receiving piled-up sheets, where an inclination provided to the compartment bottom surfaces to facilitate the paper feed rollers in dragging the paper downwardly into the paper shredding blades in a smooth manner, so as to significantly simplify the structure of the mechanism for applying a force to the paper at specific locations into a form of longitudinal movable paper press rollers thereby improving competitiveness in the commercial market.

To achieve the above objects and to overcome the shortcoming of the prior art, this invention discloses an improved compartment of shredder for receiving piled-up sheets, including: a pair of longitudinal movable paper press rollers applying pressure to the piled-up sheets continuously; a compartment for receiving piled-up sheets; a pair of rollers capable of feeding paper continuously; and paper shredding blades located beneath the paper feed rollers; wherein, the compartment bottom is provide with a narrower platform next to the paper feed rollers, the platform being formed with a paper entry and Y-shaped guide grooves at a center thereof, and the platform being provided at two opposing outer surfaces with compartment bottom surfaces inclining downwards, the bottom surfaces then extending vertically upwards to form compartment sidewalls. As such, when the piled-up sheets are placed in the compartment, the paper would form opposing upward curvatures along with the inclination of the compartment bottom surfaces in accompaniment with a force applied to the paper at specific locations by the longitudinal movable paper press rollers, thereby facilitating the paper feed rollers in dragging the paper downwardly into the paper shredding blades in a smooth manner.

BRIEF DESCRIPTION OF THE DRAWINGS

These and other modifications and advantages will become even more apparent from the following detained description of a preferred embodiment of the invention and from the drawings in which.

DETAILED DESCRIPTION OF THE INVENTION

Preferred Embodiments

The paper shredding device for shredding paper adopted by this invention is not limited to the conventional stripe-cut type or cross-cut type shredders. However, to prevent overfilling the wastebasket for containing the paper shreds in a short period of time, it is preferred that the paper shredding device is capable of shredding the paper into fragmentary pieces.

Figure 1:
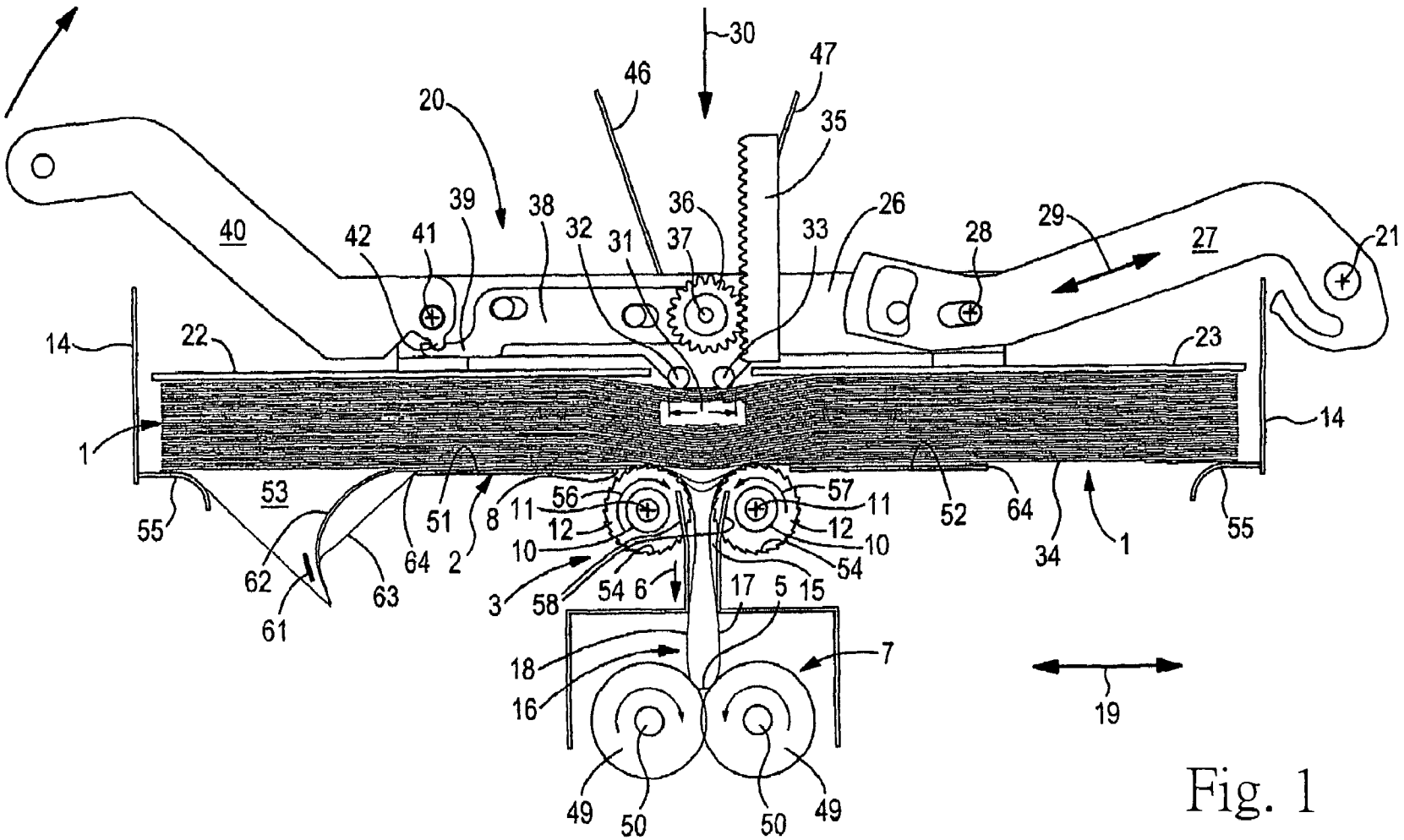
Fig. 1 Prior Art
FIG. 1 is a schematic view showing the subject matter of WO01/54820A1.
Figure 2:
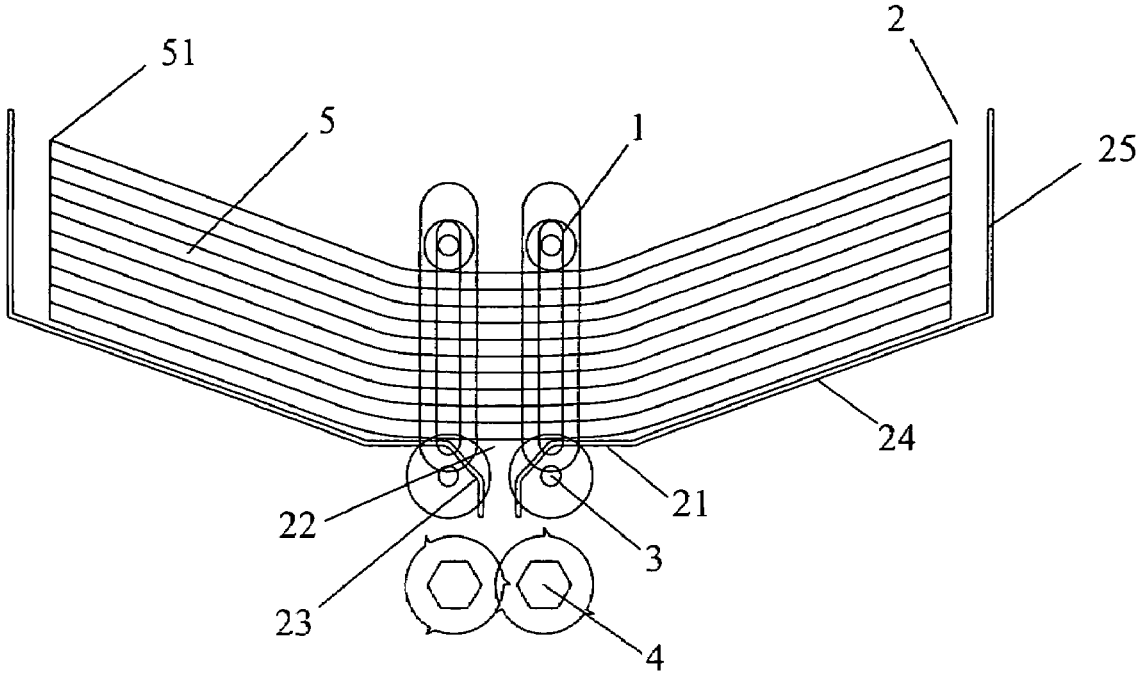
FIG. 2 illustrates a schematic view of an improved compartment of compartment of shredder for receiving piled-up sheets of this invention.

FIG. 2 illustrates a schematic view of an improved compartment of compartment of shredder for receiving piled-up sheets of this invention. As shown, the improved compartment of compartment includes: a pair of longitudinal movable paper press rollers 1 applying pressure to the piled-up sheets continuously; a compartment for receiving piled-up sheets 2; a pair of rollers 3 capable of feeding paper continuously; and paper shredding blades 4 located beneath the paper feed rollers 3. The compartment 2 is provided with a narrower platform 21 at a bottom thereof next to the paper feed rollers 3. The platform 21 is provided at two opposing outer surfaces with compartment bottom surfaces 24 inclining downwards. The bottom surfaces 24 then extend vertically upwards to form compartment sidewalls 25. The platform 21 is provided at a center thereof with a paper entry 22 and Y-shaped guide grooves 23 recessing downwards. As such, when the piled-up sheets 5 are placed in the compartment 2, the paper 5 would form opposing upward curvatures 51 along with the inclination of the compartment bottom surfaces 24 in accompaniment with a force applied to the paper at specific locations by the longitudinal movable paper press rollers 1, thereby facilitating the paper feed rollers 3 in dragging the paper downwardly 5 into the paper shredding blades 4 in a smooth manner.

Figure 3:
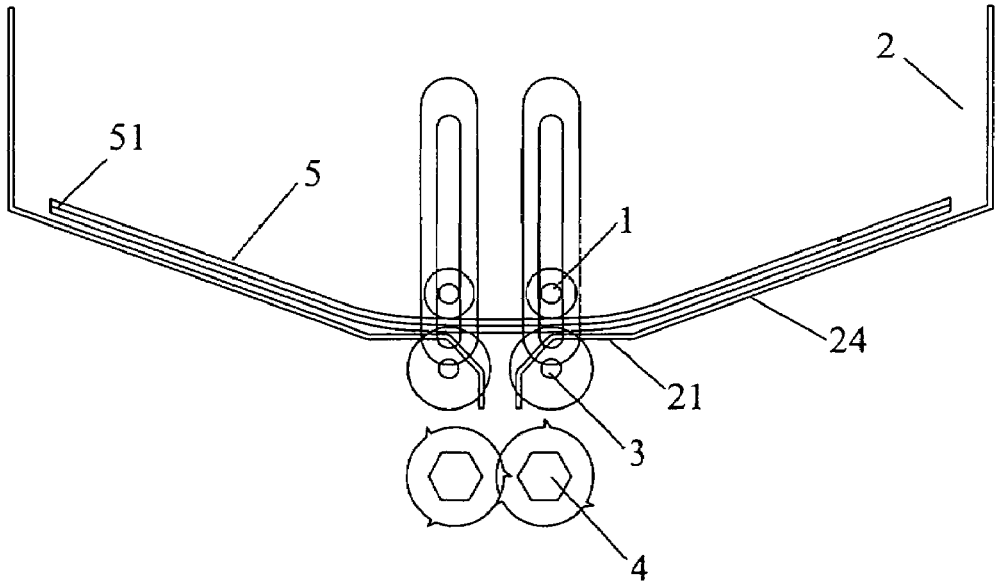
FIG. 3 illustrates a schematic view showing the improved compartment of compartment of shredder for receiving piled-up sheets of this invention in operation.

FIG. 3 illustrates a schematic view showing the improved compartment of compartment of shredder for receiving piled-up sheets of this invention in operation. When the piled-up sheets 5 are sequentially dragged downwards into the paper shredding blades 4 for shredding, the longitudinal movable paper press rollers 1 displace downwards along with the reduction of the piled-up sheets 5 (as shown in FIG. 3) so as to apply a continuous, steady and uniform force towards the paper 5.

By adopting the this invention, the inclination provided to the improvised compartment bottom surfaces facilitates the paper feed rollers in dragging the paper downwardly into the paper shredding blades in a smooth manner, so as to significantly simplify the structure of the mechanism for applying a force to the paper at specific locations into a form of longitudinal movable paper press rollers thereby achieving the object of improving competitiveness in the commercial market.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

REFERENCE NUMERALS

1 longitudinal movable paper press roller
2 compartment
21 platform
22 paper entry

23 Y-shaped guide grooves
24 compartment bottom surface
25 compartment sidewall
3 rollers
4 paper shredding blades
5 piled-up sheets

What is claimed is:

1. An improved compartment of shredder for receiving piled-up sheets, including:

a pair of longitudinal movable paper press rollers applying pressure to the piled-up sheets continuously;

a compartment for receiving piled-up sheets;

a pair of rollers capable of feeding paper continuously and paper shredding blades located beneath the paper feed rollers;

wherein, the compartment bottom is provide with a narrower platform next to the paper feed rollers, the platform being formed with a paper entry and Y-shaped guide grooves at a center thereof, and the platform being provided at two opposing outer edges with compartment bottom surfaces inclining downwards, the bottom surfaces then extending vertically upwards to form compartment sidewalls, whereby when the piled-up sheets are placed in the compartment, the paper would form opposing upward curvatures along with the inclination of the compartment bottom surfaces in accompaniment with a force applied to the paper at specific locations by the longitudinal movable paper press rollers, thereby facilitating the paper feed rollers in dragging the paper downwardly into the paper shredding blades in a smooth manner.

* * * * *